US005988624A

United States Patent [19]

Nakagawa

[11] Patent Number: 5,988,624

[45] Date of Patent: Nov. 23, 1999

[54] PAPER FEEDING DEVICE

[75] Inventor: Yuuji Nakagawa, Souraku-gun, Japan

[73] Assignee: Sharp Kabushiki Kaisha, Osaka, Japan

[21] Appl. No.: 08/749,771

[22] Filed: Nov. 20, 1996

[30] Foreign Application Priority Data

Nov. 21, 1995 [JP] Japan ..... 7-302713

[51] Int. Cl.[6] ..... B65H 5/22

[52] U.S. Cl. ..... 271/11; 271/10.03; 271/107; 271/265.01; 271/258.01

[58] Field of Search ..... 271/10.03, 11, 271/96, 107, 98, 12, 90, 95, 265.01, 258.01

[56] References Cited

U.S. PATENT DOCUMENTS

| | | | |
|---|---|---|---|
| 4,168,829 | 9/1979 | Wilson et al. . | |
| 4,509,736 | 4/1985 | Stahl et al. | 271/107 X |
| 5,673,908 | 10/1997 | Nagata et al. | 271/107 X |
| 5,833,228 | 11/1998 | Nagata et al. | 271/10.03 |
| 5,845,900 | 12/1998 | Greive | 271/98 |

FOREIGN PATENT DOCUMENTS

| | | | |
|---|---|---|---|
| 80865 | 6/1983 | European Pat. Off. | 271/90 |
| 5846356 | 3/1983 | Japan . | |
| 187137 | 7/1989 | Japan | 271/96 |
| 2147441 | 12/1990 | Japan . | |

*Primary Examiner*—William E. Terrell
*Assistant Examiner*—Patrick Mackey

[57] ABSTRACT

A cylinder-type paper feeding device designed so that the air suction fan in the paper feed cylinder is suspended at the moment each document conveyed by rotation of the paper feed cylinder reaches a sensor placed along the conveyer path, and after the lapse of a predetermined time, the paper feed cylinder is reversely rotated to return to the initial position.

2 Claims, 11 Drawing Sheets

| TABLE NUMBER | DOCUMENT-HANDLING AIR VOLUME ($mH_2O$) |
|---|---|
| 1 | 40 |
| 2 | 43 |
| 3 | 46 |
| 4 | 49 |
| ⋮ | ⋮ |
| n | 67 |

TABLES OF DOCUMENT-HANDLING AIR VOLUME (10 STEPS)

FIG. 7

| TABLE NUMBER | DOCUMENT-SUCKING AIR VOLUME ($mH_2O$) |
|---|---|
| 1 | 50 |
| 2 | 54 |
| 3 | 58 |
| 4 | 62 |
| ⋮ | ⋮ |
| n | 78 |

TABLES OF DOCUMENT-SUCKING AIR VOLUME (8 STEPS)

FIG. 8

| TABLE NUMBER | VERTICAL POSITION OF DOCUMENT-STACKING SECTION (mm) |
|---|---|
| 1 | 30.0 |
| 2 | 30.2 |
| 3 | 30.4 |
| 4 | 30.6 |
| ⋮ | ⋮ |
| n | 35.0 |

TABLES OF VERTICAL POSITIONS OF DOCUMENT-STACKING SECTION (26 STEPS)

FIG. 9

PAPER FEEDING DEVICE

BACKGROUND OF THE INVENTION

1. Field of the Invention

The present invention relates to a paper feed device which picks up and feeds the uppermost sheet from a stack of loaded sheets of paper by suction.

2. Description of the Related Art

Paper feeding devices for picking up and feeding the uppermost or lowermost sheet from a stack of loaded sheets of paper are used in a variety of systems such as copiers or printers. General methods of picking up a single sheet from such a stack of sheets of paper use rollers or suction mechanisms. The invention relates to a method of feeding paper using a suction mechanism. The configurations of suction-based paper feeding devices of the prior art will now be explained with reference to Japanese Utility Model Law Application Disclosure HEI 2-147441 and U.S. Pat. No. 4,168,829.

As illustrated in FIGS. 10A and 10B, the device disclosed in Japanese Utility Model Law Application Disclosure HEI 2-147441 is designed so as to pick out sheet materials (photosensitive materials) 102 stored in a storage case 101 sheet from the bottom of the storage case 101, with a drum placed facing the sheet material 102 pickup port. Formed on the periphery of the drum 103 are a notched, front-end suction face 104, and a following-portion suction face 105 located upstream from the front-end suction face 104 in the direction of rotation of the drum 103. Suction pores 104*a*, 105*a* are formed through the front-end suction face 104 and the following-portion suction face 105, respectively.

The inside of the drum 103 is partitioned by a partition 108 into two compartments, a front-end suction zone 106 and a following-portion suction zone 107, with the suction pores 104*a* being formed communicating with the front-end suction zone 106, and the suction pores 105*a* being formed communicating with the following-portion suction pores 107. Individual suction means are designed so as to be connected to the front-end suction means 106 and the following-portion suction means 107. Feed rollers 109 for conveying sheet materials received from the drum 103 are arranged near the drum 3, downstream from the drum 103 in the direction of rotation thereof.

A method of feeding sheet materials using this configuration will now be described. When the front-end suction face 104 is located facing the pickup port of the storage case 101 and a vacuum is applied to the front-end suction zone 106, the front end of the sheet material 102 is sucked by the front-end suction face 104. When a vacuum is applied to the following-portion suction zone 107 while rotating the drum 103 in the direction indicated by the arrow in the figure, the following portions of the sheet material 102 are sucked by the following-portion suction face 105, thereby feeding the sheet material 102. Therefore, when the application of a vacuum to the front-end suction zone 106 is suspended when the front-end suction face 104 of the drum 103 has reached the vicinity of the feed rollers 109, the front end of the sheet material come off the drum 103, and the sheet material is forwarded to the feed rollers 109. Here, the following portions of the sheet material 102 are held on the following-portion suction face 105 under suction, and the application of a vacuum to the following-portion suction zone 106 is suspended each time the front ends have been engaged between the feed rollers 109.

As illustrated in FIG. 11, the device disclosed in U.S. Pat. No. 4,168,829, designed so as to pick up and feed sheets 112 stored in a sheet cassette 111 one by one starting with the lowermost one, is equipped with a feeder 113 for picking up the sheets near the pickup port provided at the underside of the sheet cassette 111.

The feeder 113 is shaped like a drum with suction pores 114 formed on its periphery, and a vacuumn is applied to the inside of the drum so that the front end of the sheet 112 is sucked by the suction pores 114 in the vicinity of the pickup port of the sheet cassette 111. A roller 16 is placed downstream from the feeder 113 in the direction of rotation thereof. A recessed portion 113*a* is formed along part of the periphery of the feeder 113, with a bearing 115 being fit in the recessed portion 113*a*, as illustrated in the side view. The vertical position of the periphery of the bearing 115 is designed to be the same as that of the periphery of the feeder 113, with the roller 116 being in contact with the bearing 115.

An explanation will now be given regarding how the sheets 112 in the sheet cassette 112 are picked up. First, application of a vacuum to the inside of the feeder 113 is initiated when the suction pores 114 of the feeder 113 are located near and facing the pickup port of the sheet cassette 111, and the front end of each sheet 112 is sucked by the suction pores 114 on the periphery of the feeder 113. When the feeder 113 in this state is rotated in the direction indicated by the arrow in the drawing, the sheet 112 is forwarded to the position of the roller 116, at which position the sheet 112 is held between the feeder 113 (specifically, the bearing 115) and the roller 116. Therefore, even if the application of a vacuum which serves to suck the front end of the sheet is suspended at this point in time, the sheet 112 remains held between the feeder 113 and the roller 116, thereby allowing the sheet 112 to be passed to a transfer roller (not shown).

In the case of the device described in Japanese Utility Model Law Application Disclosure HEI 2-147441, the vacuums in the two suction zones 106 and 107 must be individually controlled, and this incurs the problem of complicated configuration, the problem of complicated control, the problem of ease of warp of the sheets due to the mechanism of holding the sheets by air suction only, and the problem of increased amount of air required, increased air loss and larger suction motors due to the individual control of the two zones.

On the other hand, in the case of the device described in U.S. Pat. No. 4,168,829, since the picked up sheet 112 is conveyed in the state sandwiched between the bearing 115 fit in the feeder 113 and the roller 116, the recessed portion 113*a* must be formed on the periphery of the feeder 113 to match the vertical position of the periphery of the bearing 115 with that of the periphery of the feeder 113, in order to prevent the sheets from warping or being otherwise deformed, which results in the complicated configuration of the feeder 113; this not only directly increases the cost, but also presents the problem of complicating even the method of fitting the bearing 115 into the feeder 113, the problem of smudging of the sheets by anti-corrosive oil, etc. on the bearing 115 because of the direct contact of the bearing 115 with the sheets, and the problem of insufficient sheet conveyance capacity due to the small, fixed area for conveying the sheets in the state sandwiched between the bearing 15 and the roller 116, since the bearing 115 is usually a specification product with fixed sizes including width.

Further, since the suction section 114 for sucking the front end of each sheet is provided on the periphery of the drum-shaped feeder 113 so that the front end of each sheet is sucked by the arc periphery, and therefore air tends to leak before and after the suction section 114 in the direction of feeding of the sheets 112 due to the stiffness of the sheets 112; additional problems include the lower suction, increased noise due to the air leakage, and increase in size of the air suction motors which is needed to secure a sufficient volume of air.

SUMMARY OF THE INVENTION

The present invention provides an inexpensive paper feeding device which is easy to construct and control and which does not need a larger fan or motor, and a paper feed device which is free from decrease in suction, air leakage and smudgy sheet problems, and which secures the sheet (such as original documents) feed speed, and prevents the sheets from jamming due to paper feed failures.

The paper feeding device according to the invention is a paper feeding device equipped with an air-blowing fan for blowing air on the side of a plurality of loaded sheets and designed so that the uppermost sheet is sucked and conveyed by a paper feed cylinder provided above the sheets, characterized in that the air suction fan in the paper feed cylinder is suspended at the moment each sheet conveyed by the rotation of the paper feed cylinder reaches a sensor placed along the conveyance path, and after the lapse of a predetermined time, the paper feed cylinder is reversely rotated to return to the initial position.

With the paper feeding device mentioned above, the sheet conveyance speed may be maintained by switching off the suction fan at the moment when the sheet reaches the position of the sensor placed along the sheet conveyance path by the rotation of the cylinder, and switching off the solenoid after the lapse of a predetermined time (returning the paper feed cylinder to the initial position).

The paper feeding device according to the invention is preferably designed so as to repeat the operation of feeding a sheet when the sensor cannot detect a sheet even at the conclusion of a predetermined elapsed time after the initiation of rotation of the paper feed cylinder, and thus it is judged that the paper feed has failed.

A preferable embodiment of the paper feeding device according to the invention, capable of repeating the suction operation unless the sensor is switched on when a predetermined time has expired after the initiation of rotation of the cylinder in addition to producing the effects mentioned above, allows a fast suction operation through a single normal suction.

In addition, the frequency of jamming may be reduced by repeating the sheet feed when a sheet feed failure occurs.

A constant job speed may be maintained without adversely affecting the subsequent normal suction operation by setting the predetermined time shorter than the timeing until the next normal suction operation is initiated.

With an embodiment of the paper feeding device according to the invention which is equipped with means of stepwise adjusting the volume of air from the air-blowing fan, when it is judged that a sheet feed failure has occurred, both the air-blowing fan and the air suction fan are suspended, and after the paper feed cylinder has been returned to the initial position, the volume of air from the air-blowing fan is raised by one step to repeat the sheet feed operation.

According to the embodiment described above, the air pressure for handling the sheet increases by the one-step raise in the last volume of blown air when a sheet feed failure is judged to have occurred.

The increased air pressure for picking up a single sheet facilitates the pickup of a single sheet from the other sheets, and this prevents sheet feed failures due to erroneous handling.

Another embodiment of the paper feeding device according to the invention is equipped with means of stepwise adjusting the volume of air from the air suction fan, and when it is judged that a sheet feed failure has occurred, both the air-blowing fan and the air suction fan are suspended, and after the paper feed cylinder has been returned to the initial position, the volume of air from the air suction fan is raised by one step to repeat the sheet feed operation.

According to the embodiment described above, the air pressure for handling the sheet increases by the one-step raise in the last volume of suction air when a sheet feed failure is judged to have occurred.

The increased air pressure for sucking the sheet facilitates sucking of the sheet by the sheet feed cylinder to prevent sheet feed failures due to insufficient suction.

Yet another embodiment of the paper feeding device according to the invention is equipped with means of stepwise adjusting the vertical position of the sheet-stacking section, and when it is judged that a sheet feed failure has occurred, both the air-blowing fan and the air suction fan are suspended, and after the paper feed cylinder has been returned to the initial position, the vertical position of the sheet-stacking section is raised by one step to repeat the sheet feed operation.

According to the embodiment described above, the distance from the sheet feed cylinder is shortened by the one-step raise in the last vertical position of the sheet-stacking section. The decreased distance from the sheet feed cylinder facilitates the sheets to be sucked, thus preventing sheet feed failures.

BRIEF DESCRIPTION OF THE DRAWINGS

Other and further objects, features, and advantages of the invention will be more explicit from the following detailed description taken with reference to the drawings wherein:

FIG. 7 lists tables of the volume of air (from an air-blowing fan) used for handling documents, which are stored in a memory;

FIG. 8 lists tables of the volume of air (from an air suction fan) used for handling documents, which are stored in a memory;

FIG. 9 lists tables of the vertical positions of the document-stacking section, which are stored in a memory.

DETAILED DESCRIPTION OF THE PREFERRED EMBODIMENTS

Figure 1:
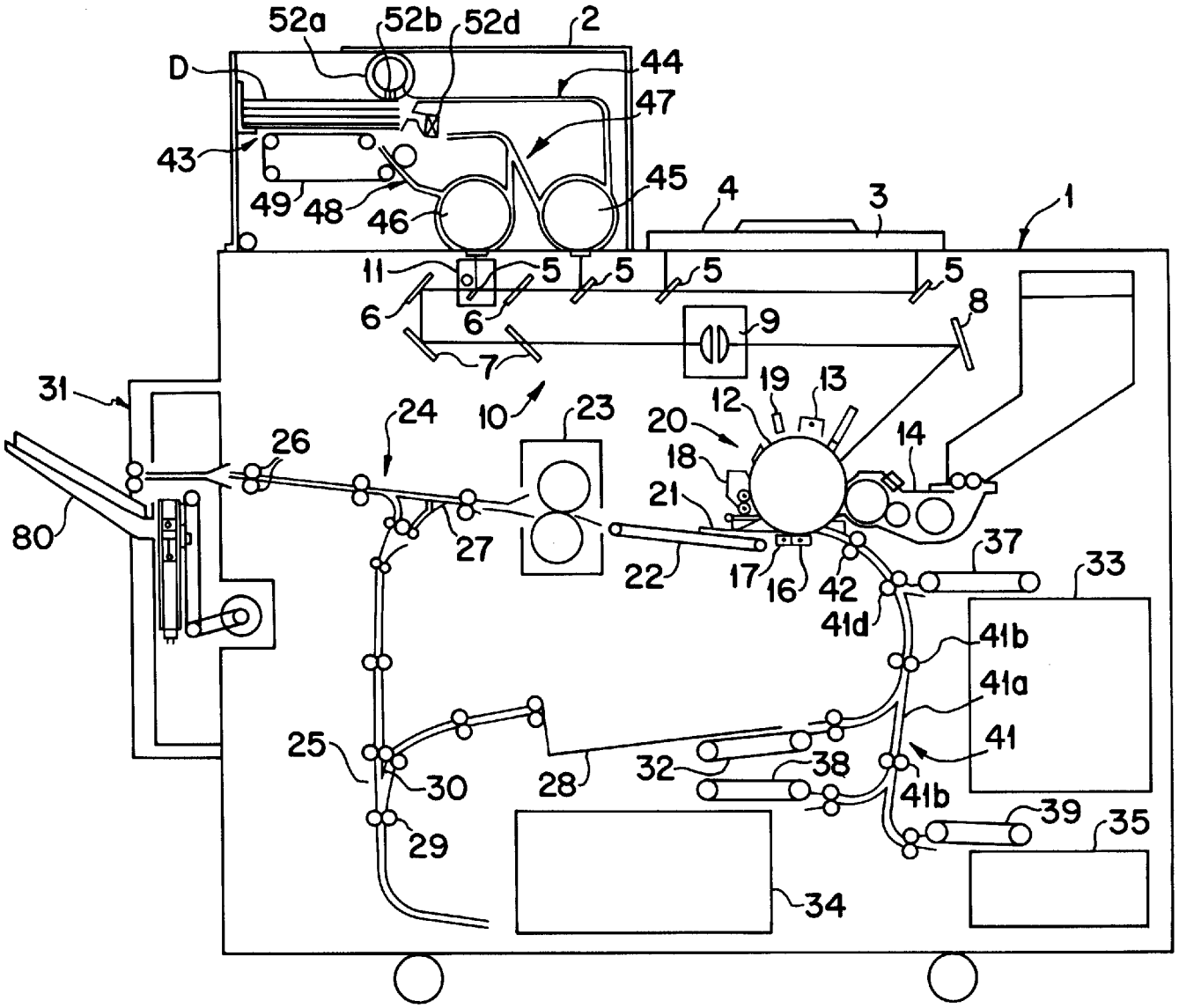
FIG. 1 is a schematic cross-sectional view of an image-forming apparatus provided with a recirculating document handler (hereunder abbreviated to "RDH"), in which the paper feeding device according to the present invention is used.

Now referring to the drawings, preferred embodiments of the invention are described below.

Figure 2:
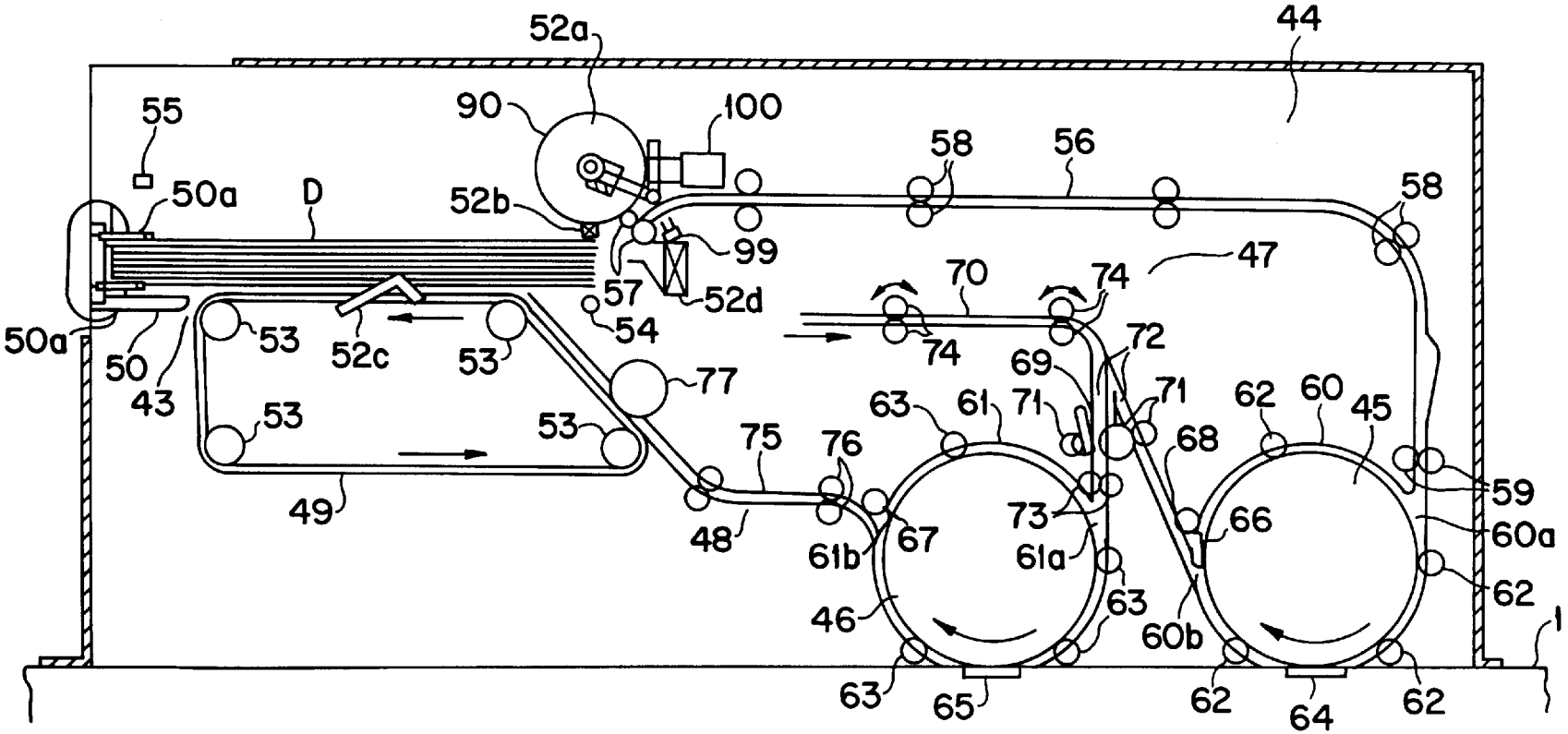
FIG. 2 is a schematic diagram of the RDH mounted on the image-forming apparatus illustrated in FIG. 1.
Figure 3:
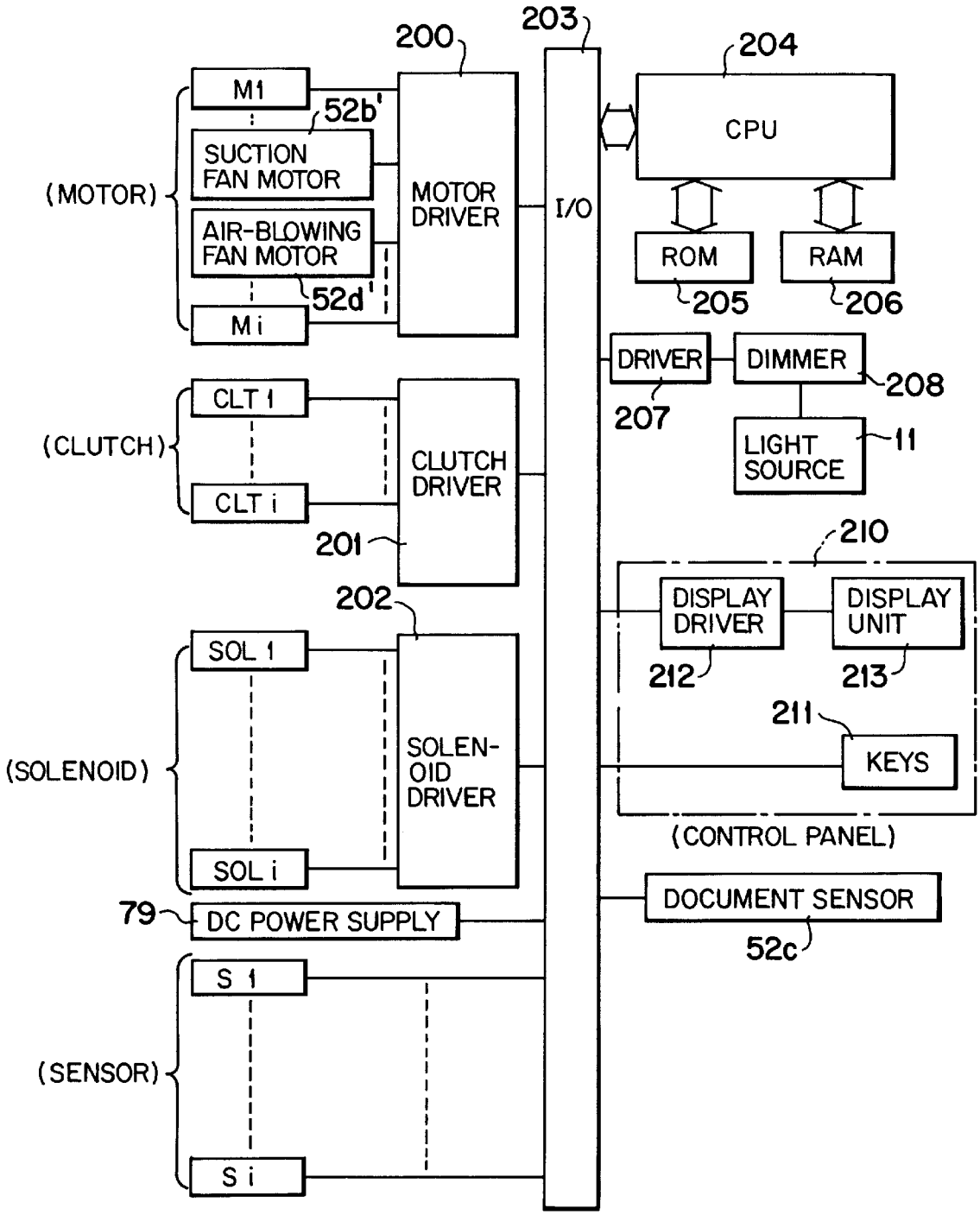
FIG. 3 is a block diagram of the control system of the image-forming apparatus illustrated in FIG. 1.
Figure 4:
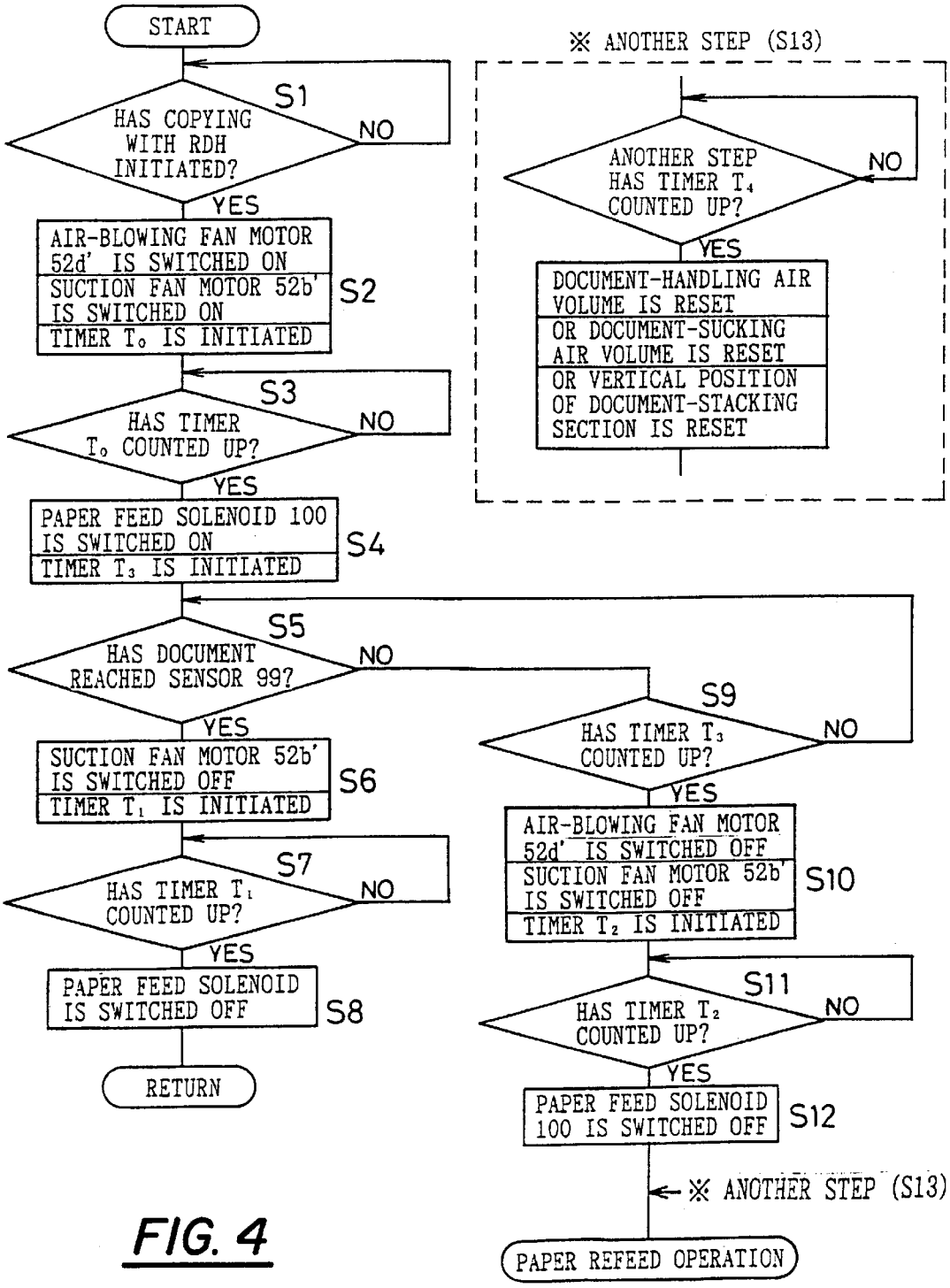
FIG. 4 is a flow chart illustrative of the operation of the paper feeding device according to the invention.
Figure 5:
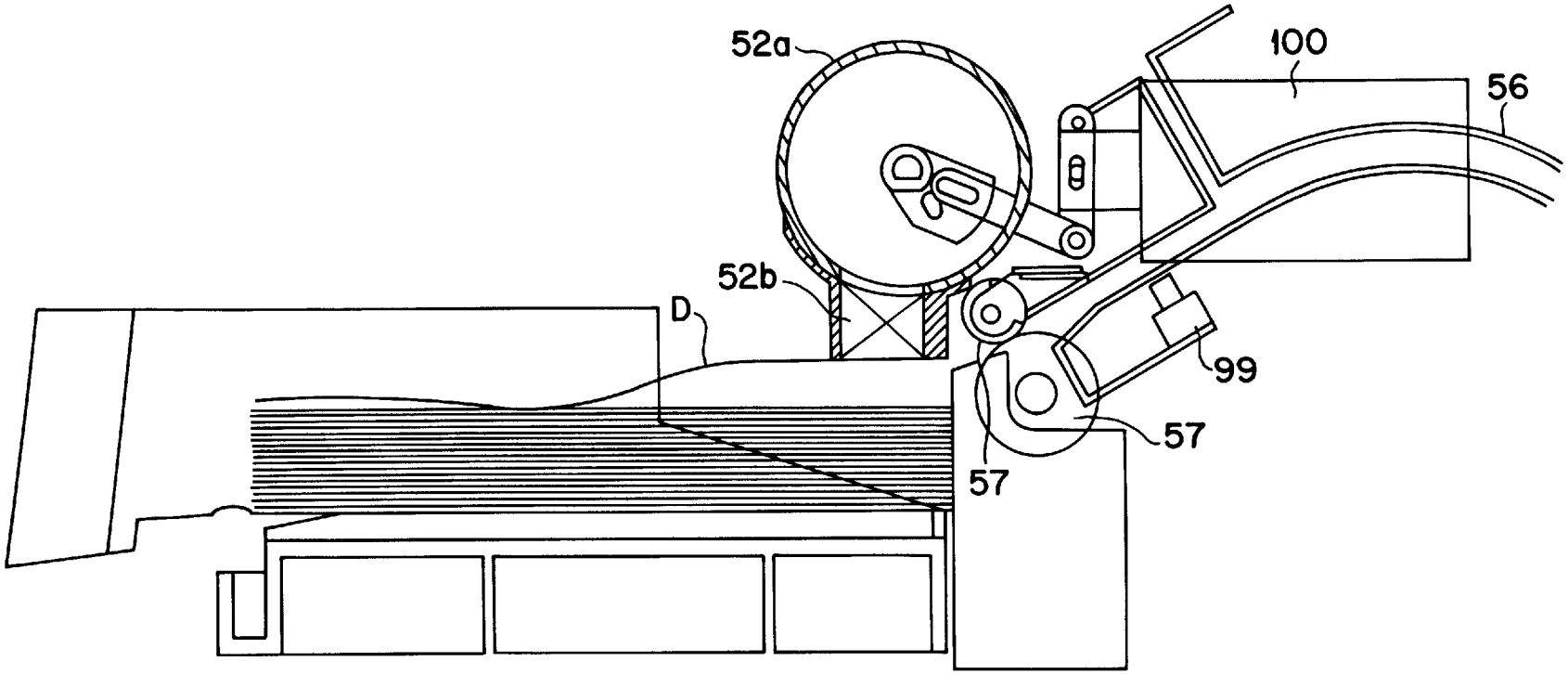
FIG. 5 is a cross sectional view of the cylindrical sheet-feed section which is an integral part of the paper feeding device according to the invention (during document suction)
Figure 6:
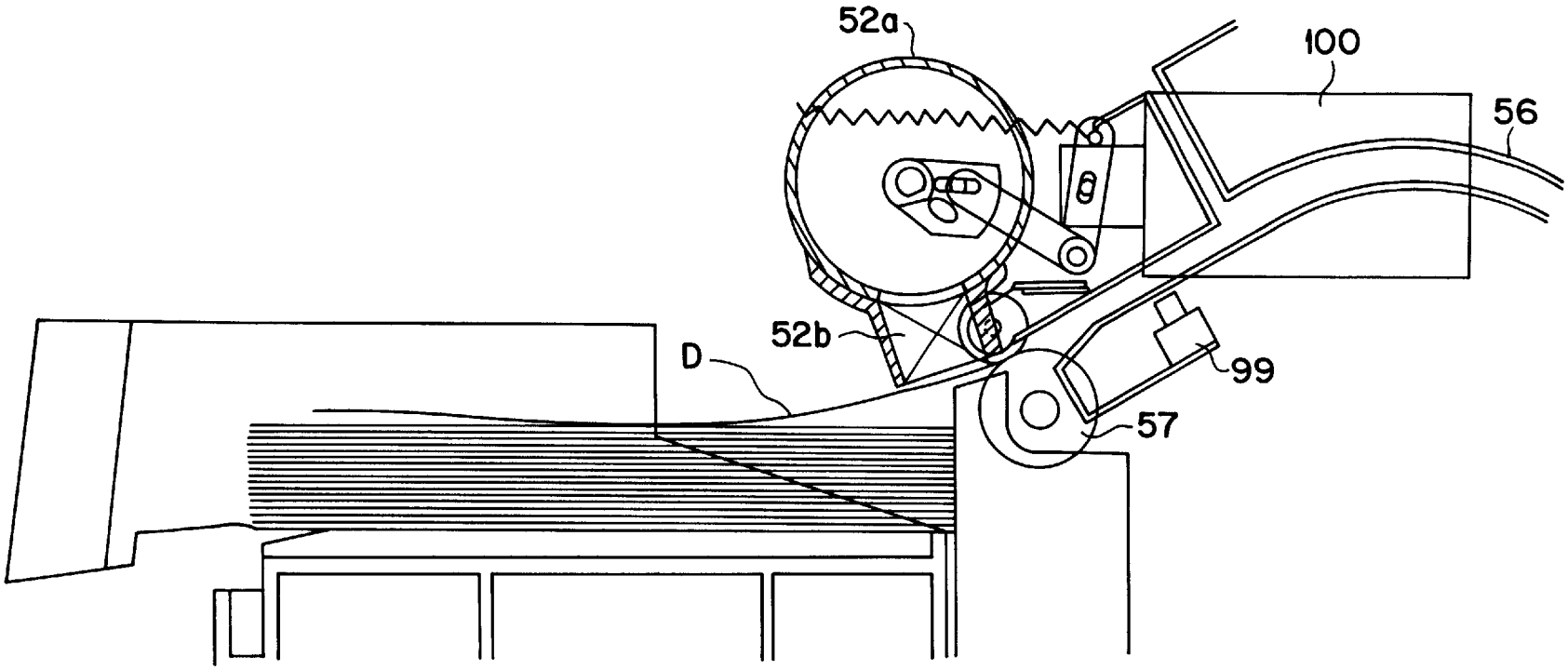
FIG. 6 is a cross sectional view of the cylindrical sheet-feed section which is an integral part of the paper feeding device according to the invention (during sheet conveyance)
Figure 10A:
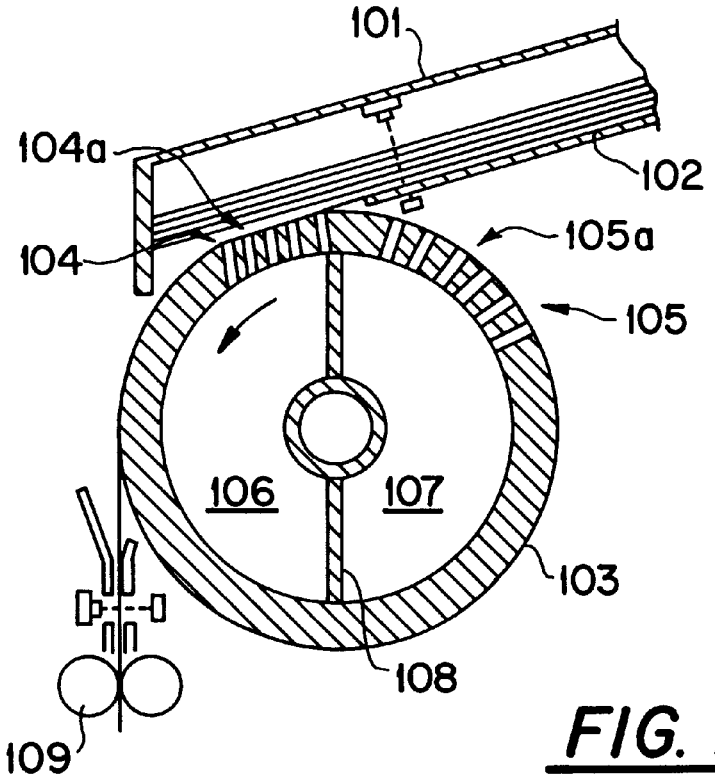
FIG. 10A (PRIOR ART)
FIG. 10A is an illustration of the configuration of a prior art paper feeding device (during document suction)
Figure 10B:
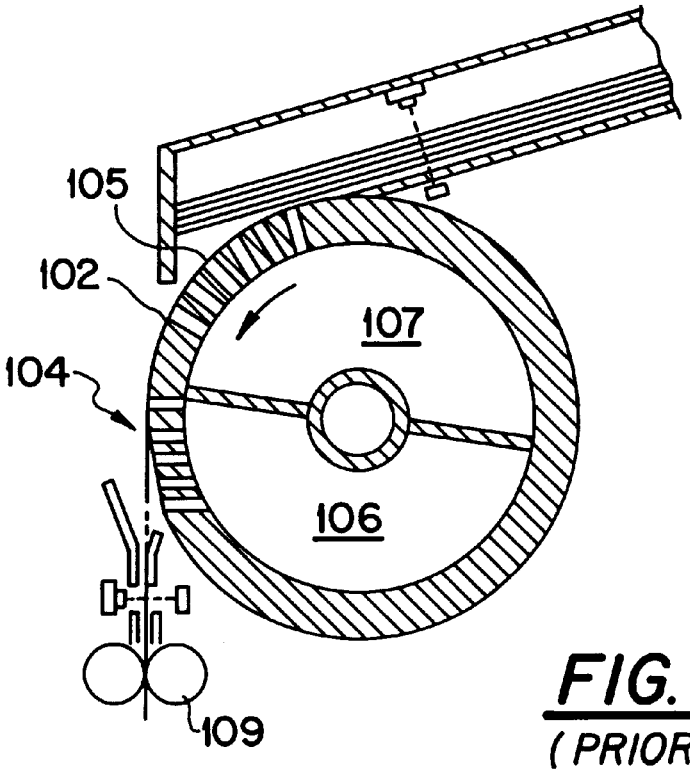
FIG. 10B (PRIOR ART)
FIG. 10B is an illustration of the configuration of the prior art paper feeding device (during document conveyance)
Figure 11A:
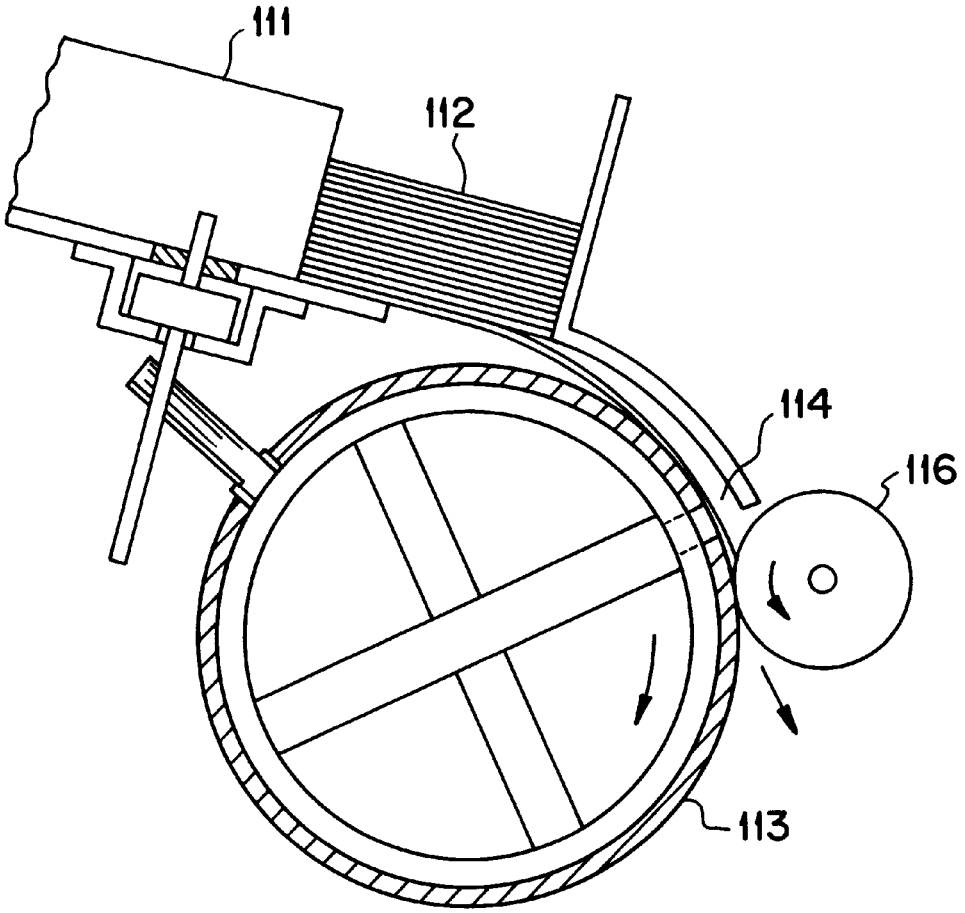
FIG. 11A (PRIOR ART)
FIG. 11A is an illustration of the configuration of another prior art paper feeding device.
Figure 11B:
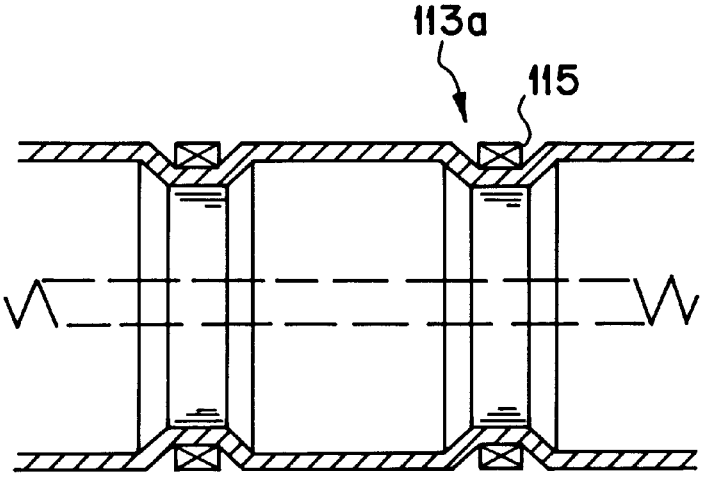
FIG. 11B (PRIOR ART)
FIG. 11B is a cross sectional view of the feeder along its axial direction included in the prior art paper feeding device.

FIG. 1 is a schematic cross-sectional view of image-forming apparatus provided with an RDH, in which the paper feeding device according to the present invention is used. FIG. 2 is a schematic diagram of the RDH mounted on the image-forming apparatus illustrated in FIG. 1, FIG. 3 is a block diagram of the control system of the image-forming apparatus illustrated in FIG. 1, FIG. 4 is a flow chart for carrying out the invention, and FIG. 5 and FIG. 6 are cross sectional views of the cylindrical sheet-feed section which is an integral part of the paper feeding device according to the invention.

According to an embodiment of the invention which is illustrated in FIG. 1, placed on a main body 1 of a copying machine are an RDH and document table 3 located adjacent to the RDH 2. The document table 3, made of translucent glass, is covered with a hinged document cover 4 which presses and holds the document (not shown) placed on the document table 3.

An optical system 10 comprising mirrors 5–8 and a lens 9 are placed below the RDH 2 and the document table 3. The optical system 10 is designed so as to irradiate the document with the light incident from a light source 11 for optical scanning and concurrently to catch the light reflected from the document and guide the light to a photoconductor drum 12.

The light source 11 moves along the document table 3 to optically scan the document when the document placed on the document table 3 is being copied, whereas the document is optically scanned with light guided through an optical scanning window 64 or 65 (see FIG. 2) when copying is being performed using the RDH 2.

The photoconductor drum 12 is placed below the optical system 10 in such a manner as to allow a rotation thereof in a clockwise direction in the figure. Placed around the photoconductor drum 12 are a charger 13, a developer unit 14, a transfer unit 16, a peeling unit 17, a cleaning unit 18, an antistatic lamp 19, etc, which are to form a copy processing section 20. The copy processing section 20 is designed so as to develop the electrostatic latent image formed on the photoconductor drum 12 by the light from the optical system 10 as a toner image, and to transfer the toner image to a copying paper which is fed from paper feed cassettes 33–35 or an intermediate tray 28.

A conveyer belt 22 and a fixing section 23 are placed at the paper ejection side of the copy processing section 20 so that the copying paper which has undergone a predetermined copying process in the copy processing section 20 is conveyed to the fixing section 23 by the conveyer belt 22 to heat and fix the toner image transferred onto the copying paper in the fixing section 23.

A conveyance switch section 24 is provided at the paper ejection side of the fixing section 23. The conveyer switch section 24 is equipped with a gate flapper 27 for switching the path of the copying paper to either an off-set tray 31 or an intermediate tray 28. For single-sided copying, the copying paper is ejected onto a paper ejection tray 80 which constitutes an offset tray 31 via a reverse roller 26. Here, the offset tray 31 is designed so as to allow adjustment of the vertical position of the paper ejection tray 80 depending on the number of the ejected sheets of copying paper.

On the other hand, in the case of double-sided copying, the copying paper is conveyed toward a reverse conveyer section 25 equipped with a gate flapper 30, and the direction of conveyance thereof is reversed by the reverse roller 29 to eject the copying paper onto the intermediate tray 28. The intermediate tray 28 is located below the conveyer belt 22 and the fixing section 23. The sheets of copying paper in the intermediate tray 28 are designed to be successively sent toward the photoconductor drum 12 at predetermined timings, starting with the lowermost sheet, by an air suction-based delivery belt 32.

The paper feed cassette 34 is arranged below the intermediate tray 28, and the paper cassettes 33, 35 are arranged below the developer unit 33, 35. It is designed so that virgin sheets of copying paper loaded in the paper feed cassettes 33–35 are successively fed by air suction-based paper feed belts 37–39 provided at the paper ejection side, starting with the uppermost sheet.

A resist roller 42 for feeding the conveyed sheets of copying paper to the photoconductor drum 12 at predetermined timings, if necessary, after having temporarily stopped the sheets, is provided at the photoconductor drum 12 side of a feeder/conveyer section 41 which comprises a conveyance path 41*a* branching to the respective paper feed cassettes 33–35 and a plurality of conveyer rollers 41*b*, and is provided along the path from the intermediate tray 28 and the paper feed cassettes 33–35 to the photoconductor drum 12.

The RDH 2 will now be explained in detail.

As illustrated in FIG. 2, the RDH 2 is equipped with a document-stacking section 43, a paper feed section 90, a feeder/conveyer section 44, rotating drums 45 and 46, a reverse conveyer section 47 and a return conveyer section 48.

The document-stacking section 43, constructed of the upper horizontal conveyer section of a conveyer belt 49 and a document hopper 50, is designed to stack a plurality of documents D on the upper horizontal conveyer section of the conveyer belt 49, with the ends of the documents received in the document hopper 50. A document sensor 52*c* as the document-sensing means is attached to the upside of the conveyer belt 49 so as to output a detection signal to a control system, which is described later, when it detects that documents exist in the document hopper 50.

The conveyer belt 49 looped over a drive roller 53 is designed so as to be driven and insert the documents returned after having been optically scanned, which is described later, under the document hopper 50. In order to facilitate the insertion of the documents D by the conveyer belt 49, a flap roller 54 is provided for flapping the tail ends of the documents D.

The document hopper 50 is equipped with a sensing actuator 50*a* for sensing one circulation of the stacked documents D. The sensing actuator 50*a* is located at the lowermost position indicated by the solid line in the figure until the documents D are set in the document hopper 50, and the documents D are stacked on the sensing actuator 50*a*. The sensing actuator 50*a* is elevated as the documents D are fed and returned from the return conveyer section 48 one by one, and reaches the uppermost position indicated by the broken line in the figure when one circulation of all the documents D has been accomplished. Here, the sensing actuator 50*a* at the uppermost position is detected by a one-circulation-of-documents sensor 55 placed above the document hopper 50, thus allowing the number of copied sheets, etc. to be controlled. After execution of one circulation of the documents D, the sensing actuator 50*a* travels along the outside of the document hopper 50 to rotate 180°, and returns to the lowermost position indicated by the solid line.

An air-blowing fan 52*d* as the air jet means is provided forward of the paper ejection side of the document-stacking section 43. The direction of blowing air from the air-blowing fan 52*d* is controlled so as to float one of the stacked documents D, while preventing two or more sheets of copying paper from being fed at one time.

A paper feed section 90 as the paper feed means for picking up the documents D at predetermined timings is provided above the document-stacking section 43. The paper feed section 90 is constructed of a paper feed cylinder 52*a* and a suction fan 52*b* (as the suction means) provided inside the paper feed cylinder 52*a*. The paper feed section 90 is designed so that the suction fan 52*b* is rotated to produce a stream of air (suction) in the direction from the bottom to the paper feed cylinder 52*a* to suck the uppermost document of the documents D by the periphery of the paper feed cylinder 52*a*, and the paper feed cylinder 52*a* is driven to rotate by a solenoid 100 to convey the document.

Both the suction fan 52*b* and the air-blowing fan 52*d* are designed so as to be driven to rotate by a suction fan motor 52*b*′ and an air-blowing fan motor 52*d*′, respectively, as illustrated in FIG. 3.

The feeder/conveyer section 44 is equipped with a conveyance path 56, separation rollers 57, 57, a plurality of conveyer rollers 58 arranged with predetermined spacings, and resist rollers 59, 59. The conveyance path 56 is provided extending from the paper ejection side of the document-stacking section 43 to the vicinity of the paper feed section 60*a* of a peripheral feeding path 60 which is described later.

The separation rollers 57, 57, constructed of a pair of rollers arranged vertically, are designed so as to be driven to rotate in the same direction, thereby separating the two or more documents D picked up together to prevent them from being fed concurrently. On the other hand, the resist rollers 59, 59 are designed so as to feed each document D conveyed by the conveyer rollers 58 to the rotatory drum 45 at a predetermined timing, if necessary after having temporarily stopped it.

The rotatory drums 45, 46, which are both designed so as to be driven to rotate in a clockwise direction, are provided with conveyance paths 60, 61 in circular cross section formed on the peripheries thereof, respectively. The peripheral conveyance paths 60, 61 are provided with a plurality of spaced follower rollers 62, 63 in a freely rotatable manner and in contact with the peripheries of the rotatory drums 45, 46. The follower rollers 62, 63 are designed so as to press each document D against the rotatory drums 45, 46 to facilitate conveying the document.

Optical scanning windows 64, 65 both made of glass are located at such positions on the upper surface of the main body 1 of the copying machine as to face the lower ends of the rotatory drums 45, 46, and the documents D are optically scanned by the light transmitted from the light source 11 (see FIG. 2) through the optical scanning windows 64, 65.

The respective paper ejection sections 60*b*, 61*b* of the peripheral conveyance paths 60, 61 are provided with gate flappers 66, 67 for switching the path of each document D. When the same document D is being optically scanned a plurality of times for multicopying, the gate flappers 66, 67 are designed so that the paper ejection sections 60*b*, 61*b* of the peripheral conveyer paths 60, 61 are closed, as indicated by the phantom lines, to form the peripheral conveyance paths 60, 61 in circular cross section on the peripheries of the rotatory drums 45, 46, thus allowing the document D to circulate around the rotatory drums 45, 46 a desired number of times.

The device is designed so that when the optical scanning has been repeated a predetermined number of times, or no optical scanning is performed, the gate flapper 66 rotates to the position indicated by the solid line to close the upper half of the peripheral conveyance path 60, thereby forming a path which leads the document D to the reverse conveyer section 47, while the gate flapper 67 rotates to the position indicated by the solid line to close the upper half of the peripheral conveyance path 61, thereby forming a path which leads the document D to the return conveyer section 48.

The reverse conveyer section 47 has conveyance paths 68, 69, a reverse conveyance path 70, a forward roller 71, a gate flapper 72, resist rollers 73, 73, and reverse rollers 74, 74. The conveyance paths 68, 69 have one end connected to the paper ejection section 60*b* of the peripheral conveyance path 60 and the paper feed section 61*a* of the peripheral conveyance path 61, respectively, and the other end merged with each other and connected to the reverse conveyance path 70.

The forward roller 71 is provided near the confluence of the conveyance paths 68, 69 to forward each document D to the reverse conveyance path 70 or to the rotatory drum 46, and the gate flapper 72 is designed so as to switch the path of the document D. The resist rollers 73, 73 are provided near the paper feed section 61*a* along the conveyance path 69, and is designed to feed each document D to the rotatory drum 46 at a predetermined timing, if necessary after having temporarily stopped the document D. On the other hand, the reverse rollers 74, 74 are provided along the reverse conveyance path 70, and are designed to reverse the direction of conveyance of the document D by reversing the directions of rotation of the rollers.

The return conveyance path 48 has a conveyance path 75 and a plurality of conveyer rollers 76. The conveyance path 75 extends from the paper ejection section 61*b* of the peripheral conveyance path 61 to the conveyer belt 49. The conveyer belt 49 is part of both the document-stacking section 43 and the return conveyer section 48, and serves to convey the documents returned via the conveyance path 75 to the document-stacking section 43. To achieve this, a guide roller 77 is provided near the mouth of the conveyance path 75 at the paper ejection side to facilitate feeding of the documents D by the conveyer belt 49.

The control system will now be described.

As illustrated in FIG. 3, the control system, which is equipped with a microcomputer 204 comprising a CPU, controls the main body 1 of the copying machine and the RDH 2, including their interrelation.

A plurality of motors M1–Mi for driving rotary members such as the photoconductor drum 12, the respective conveyer rollers 41*b*, 58 in the main body 1 of the copying machine and the RDH 2, etc. the suction fan motor 52*b*′ for driving the suction fan 52*b*, and the air-blowing fan motor

52*d*′ for driving the air-blowing fan 52*d* (none of the motors are illustrated in FIG. 1 and FIG. 2) are connected to a motor driver 200. On the other hand, a plurality of clutches CLT1–CLTi for intermittently driving the respective resist rollers 42, 59, etc., are connected to a clutch driver 201, and a plurality of solenoids SOL1–SOLi for driving the respective gate flappers 27, 30, etc. are connected to a solenoid driver 202.

Connected to an interface circuit 203 are the respective drivers 200–202, a DC power supply 79, and the respective control elements used for the control of conveyance of the documents, the control of conveyance of the copying paper and the control of the copy processing section 20, such as the document sensors S1–Si for sensing passage of the copying paper or the documents D at predetermined points, a plurality of sensors 52*c* for sensing that documents exist in the document hopper 50, etc.

The interface circuit 203, which is connected to the microcomputer 204, is designed so as to output detection signals from the detection sensors S1–Si and the document sensor 52*c* to the microcomputer 204, so as to control the operation of the respective drivers 200–202 depending on the control signals from the microcomputer 204.

The microcomputer 204 is connected to a ROM (Read Only Memory) 205 and a RAM (Random Access Memory) 206, and is designed so as to perform the control according to the control program prestored in the ROM 205. This control includes the control for simplex/duplex copying. On the other hand, the RAM 206 is used as a buffer memory or as a flag, counter, timer or another operational area which is required for controlling copying.

The interface circuit 203 is connected to the light source 11 via a driver 207 and a dimmer 208. The interface circuit 203 is also connected to the operation keys 211 on the control panel 210, and further to the display unit 213 via a display driver 212.

The operation of feeding sheets according to the invention will now be described with reference to the flow chart of FIG. 4, and FIGS. 3, 5 and 6.

For copying, the operator first inverts a given number of documents D so that the side to be copied is face down, then stacks the documents D in the document-stacking section 43 in order of page numbers, with the final page located uppermost. When the operator instructs to initiate copying by pressing the copy switch of the keys 211 on the control panel 210, the microcomputer 204 operates to initiate rotation of the suction fan motor 52*b*′ and the air-blowing fan motor 52*d*′ (S1, S2.).

This initiates rotation of the air-blowing fan 52*d* to blow air at the documents D to prevent two or more of the documents D from being fed together, thus allowing only a single document D to float, and the uppermost document D is sucked by the paper feed cylinder 52*a* with the aid of the suction fan 52*b*. When the paper feed cylinder 52*a* starts to rotate by switching on the paper feed solenoid 100 after the lapse of a predetermined time after completion of suction of the document D by the paper feed cylinder 52*a* (after a timer $T_0$ has counted up) (S3, S4), the document D sucked by the paper feed cylinder 52*a* is conveyed, passed between the separation rollers 57, 57, and reaches the sensor 99 placed along the document conveyance path (S5), at which time the suction fan motor 52*b*′ is switched off, a timer $T_1$ is initiated, and the paper feed solenoid 100 is switched off to return the paper feed cylinder 52*a* to the initial position when the timer $T_1$ counts up after the lapse of a predetermined time. Here, by making the time set on the timer $T_1$ shorter than the timing until the next sucking operation is initiated, a constant job speed is maintained without adversely affecting the next sucking operation (S6–S8).

FIG. 5 illustrates the suction of a document by the paper feed cylinder, and FIG. 6 illustrates feeding of a document by the paper feed cylinder.

In cases where the sensor 99 is not turned on even after the lapse of a predetermined time after the paper feed solenoid 100 has been switched on (even after a timer $T_3$ has counted up), on judging that a paper feed failure has occurred (the document D has slipped and failed to be sucked by the paper feed cylinder 52*a*), the suction fan motor 52*b*′ and the air-blowing fan motor 52*d*′ are switched off and a timer $T_2$ is initiated. When the timer $T_2$ has counted up after the lapse of a predetermined time, the paper feed solenoid 100 is turned off, and the paper feed operation is repeated (S9–S12).

It is rather difficult to prevent the occurrence of document feed failures only by repeating the same paper feed operation as the paper refeed operation. Therefore, when it is judged that a document feed failure has occurred, the timer $T_2$ is initiated at the moment the suction fan motor 52*b*′ is switched off, and immediately after the timer $T_2$ has counted up after the lapse of a predetermined time, the paper feed solenoid 100 is turned off, and a timer $T_4$ is concurrently initiated. When the timer $T_4$ has counted up, the data in the second table of the tables (see FIG. 7) of the volumes of air for handling documents which are prestored in a memory, is read to set the volume of air for handling the documents (S13). Likewise, the data in the "n"th table is read for the "n"th trial for paper feed. Paper feed failures due to mishandling the documents may be prevented by repeating the foregoing procedures.

When it is judged that a document feed failure has occurred, the timer $T_2$ is initiated at the moment the suction fan motor 52*b*′ is switched off, and immediately after the timer $T_2$ has counted up after the lapse of a predetermined time, the paper feed solenoid 100 is turned off, and a timer $T_4$ is concurrently initiated. When the timer $T_4$ has counted up, the data in the second table of the tables (see FIG. 8) of the volumes of air for sucking documents which are prestored in a memory, is read to set the volume of air for sucking the documents (S13). Likewise, the data in the "n"th table is read for the "n"th trial for paper feeding. Paper feed failures due to insufficient suction of the documents may be prevented by repeating the foregoing procedures.

When it is judged that a document feed failure has occurred, the time $T_2$ is initiated at the moment the suction fan motor 52*b*′ is switched off, and immediately after the timer $T_2$ has counted up after the lapse of a predetermined time, the paper feed solenoid 100 is turned off, and a timer $T_4$ is concurrently initiated. When the timer $T_4$ has counted up, the data in the second table of the tables (see FIG. 9) of the vertical positions of the document-stacking section which are prestored in a memory, is read to set the vertical position of the document-stacking section (S13). Likewise, the data in the "n"th table is read for the "n"th trial for paper feed. Paper feed failures may be prevented, since the vertical position of the document-stacking section gradually matches that of the paper feed cylinder by repeating the foregoing procedures.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claim is:

1. A paper feeding device comprising:

an air-blowing fan blowing air on the side of a plurality of loaded sheets;

a paper feed cylinder including an air suction fan sucking and conveying an uppermost sheet of the plurality of loaded sheets, the paper feed cylinder including the air suction fan located above the plurality of loaded sheets; and means including a sensors, the sensor placed along a conveyance path of the sheet, for suspending operation of the air suction fan at a moment each sheet conveyed by forward rotation of the paper feed cylinder reaches the sensor, and after the lapse of a predetermined time, the paper feed cylinder is reversibly rotated to return to an initial position thereof;

wherein when the sensor does not detect a sheet even at the conclusion of a predetermined elapsed time after the initiation of forward rotation of the feed cylinder, it is judged that the paper feed has failed, and operation of feeding the sheet is repeated.

2. A paper feeding device comprising:

an air-blowing fan blowing air on the side of a plurality of loaded sheets;

a paper feed cylinder including an air suction fan sucking and conveying an uppermost sheet of the plurality of loaded sheets, the paper feed cylinder including the air suction fan located above the plurality of loaded sheets;

a sensor placed along a conveyance path of the sheet, wherein operation of the air suction fan is suspended at a moment each sheet conveyed by forward rotation of the paper feed cylinder reaches the sensor, and after the lapse of a predetermined time, the paper feed cylinder is reversibly rotated to return to an initial position thereof wherein when the sensor does not detect a sheet even at the conclusion of a predetermined elapsed time after the initiation of forward rotation of the feed cylinder, it is judged that the paper feed has failed, and operation of feeding the sheet is repeated; and including means for stepwise adjusting the volume of air from the air-blowing fan and when it is judged that a sheet feed failure has occurred, both operation of the air-blowing fan and suction fan are suspended, and after the paper feed cylinder has been returned to the initial position, the volume of air from the air-blowing fan is raised by one step by the means for stepwise adjusting the volume of air from air-blowing fan to repeat the sheet feed operation.

* * * * *